United States Patent [19]

Zimmerman

[11] 4,343,289

[45] Aug. 10, 1982

[54] WOOD BURNING STOVE

[76] Inventor: Valentine J. Zimmerman, 224 N. 4th St., Galesville, Wis. 54630

[21] Appl. No.: 132,625

[22] Filed: Mar. 21, 1980

[51] Int. Cl.[3] ..... F24C 1/14; F24B 5/00; F24B 7/00; F24B 3/00

[52] U.S. Cl. ..... 126/77; 126/67; 126/70; 126/72; 126/15 R

[58] Field of Search ..... 126/70, 77, 67, 15 R, 126/72

[56] References Cited

U.S. PATENT DOCUMENTS

| | | | |
|---|---|---|---|
| 2,168,021 | 8/1939 | Cramer | 126/77 |
| 4,121,560 | 10/1978 | Knight | 126/67 |
| 4,136,662 | 1/1979 | Willson | 126/77 |
| 4,166,444 | 9/1979 | Martenson | 126/67 |
| 4,184,473 | 1/1980 | McIntire et al. | 126/77 |
| 4,201,185 | 5/1980 | Black | 126/77 |
| 4,221,207 | 9/1980 | Syme | 126/77 |

*Primary Examiner*—Samuel Scott
*Assistant Examiner*—Wesley S. Ratliff, Jr.
*Attorney, Agent, or Firm*—Sixbey, Friedman & Leedom

[57] ABSTRACT

An air tight wood burning stove (10) for heating a designated space comprises a housing (12) having an access opening (50) in the front wall (14) thereof and at least one glass panel (64) containing door (54, 56) hingedly mounted on the front wall for closing the opening (50). A latching mechanism (60) on the door (54, 56) engages with undercut flange means (52, 53) surrounding opening (50) for positively maintaining the door (54, 56) in the closed position. A firebrick lined combustion chamber (34) within the housing receives logs through opening (50) for burning and the production of hot combustion gases. An air chamber (48) is formed within the housing (12) in air flow communication with the combustion chamber (34) for feeding air thereto through openings (94, 96) in the air chamber walls (46, 90). A damper 92, which may be manually or thermostatically controlled, controls cool air flow from room floor level into the air chamber (48) and then through openings (94, 96) into combustion chamber (34) wherein the air is heated. The hot combustion gases and heated air rise within housing (12) and are discharged through flue means (28, 30) to the outside. In passing upwardly the gases and air flow over the outside surface of and heat the air within a plurality of air carrying tubular heat exchange conduits (98) which are disposed adjacent the top of assembly (12) and extend therethrough upwardly and forwardly from conduit air inlets at the rear wall (24) to conduit air discharge outlets at the front wall (14).

12 Claims, 6 Drawing Figures

WOOD BURNING STOVE

TECHNICAL FIELD

The present invention relates to a space heater for a room and, more particularly, to an air tight wood burning stove for use in residential heating.

BACKGROUND ART

Within the past few years, the costs of residential heating have multiplied, and supplies of fuel oil and natural gas, the predominant sources of energy for generating heat for residential heating have become increasingly uncertain. The tremendous increase in cost and the uncertainty of supply have created a great demand for efficient and economical alternative sources of heat. Many persons rely upon their fireplaces as such a source; however, the low efficiency of the conventional fireplace, even those containing installed room heating apparatus, makes it a totally inadequate solution to the problem.

More and more people have been turning to wood as the most economical, readily available source of energy for residential heating. Although in years past, wood burning stoves were immensely popular and their use widespread, the old-fashioned wood burning stoves are far to inefficient taking into account today's larger residences and increased cost of wood fuel. Therefore, if wood burning stoves are to be a practical alternative to fuel oil or natural gas fired furnaces, there is a very real need for designs which exhibit maximum fuel burning efficiency and minimum capital investment.

DISCLOSURE OF INVENTION

In one aspect of the present invention this is accomplished by providing an air tight combustion wood burning stove which includes a plurality of heat exchangers built into the firebox to reclaim combustion heat that would otherwise be lost up the chimney.

In another aspect of the present invention, the wood burning stove includes an air draft system which draws cool air off the room floor to serve as primary and secondary air for circulation within the firebox, the draft system being susceptible of either manual or thermostatic control for maximum efficiency.

In a particularly preferred aspect of the invention, the wood burning stove is constructed with an upwardly and rearwardly inclined front wall on which cast iron doors having heat tempered glass windows mounted therein are set to provide doors which stay sealed when closed, stay open when opened and which provide an aesthetically pleasing full view of the wood burning fire within the firebox.

BEST MODE FOR CARRYING OUT THE INVENTION

Figure 1:
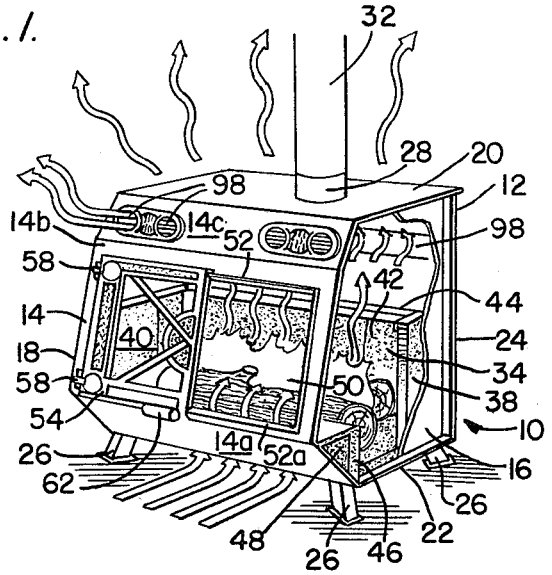
FIG. 1 is a front perspective view of the wood burning stove of the present invention with parts broken away for purposes of clarity.
Figure 2:
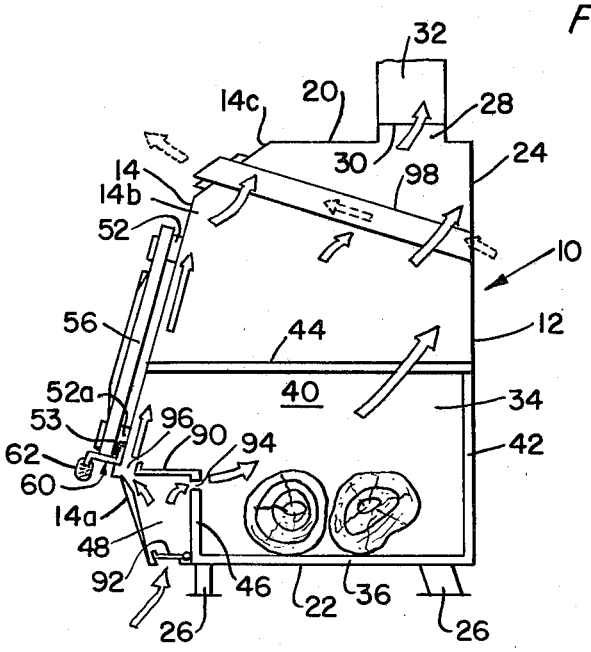
FIG. 2 is a vertical sectional elevation of the wood burning stove.

Referring to FIGS. 1 and 2 the illustrated embodiment of the invention comprises a wood burning stove 10 having a steel plate irebox housing 12 provided with a three sectional front wall 14, opposite side walls 16, 18, top wall 20, bottom wall 22 and rear wall 24. It will be appreciated that the several walls of the housing are secured together in a substantially air tight manner, as by welding. Housing 12 is preferably supported on legs 26 to space bottom wall 22 from the floor on which the stove 10 is supported. A combustion product outlet flue 28 projects upwardly from top wall 20 and communicates with the interior of the firebox housing 12 through aperture 30 formed in the top wall. Flue 28 directs the combustion products from the firebox housing 12 upwardly through chimney 32 which leads to the outside of the house.

Arranged within the lower portion of the firebox housing 12 is combustion chamber 34 which is adapted to receive the logs to be burned within stove 10. The combustion chamber is open at the top for insertion of logs therein and is formed of a bottom firebrick wall 36 lining the bottom wall 22 and side firebrick walls 38, 40 and rear firebrick wall 42 extending upwardly along the side walls 16, 18 and rear wall 24, respectively, from the bottom wall 22 to a predetermined height short of the top wall 20. The firebrick walls are supported along their upper peripheral edges by stainless steel retainers 44 fastened in a suitable manner to the adjacent housing wall. The front firebrick wall 46 of combustion chamber 34 is the rear wall of air chamber 48, as will be described more fully hereinafter.

Front wall 14 of housing 12 comprises a lower front wall section **14*a* extending forwardly and upwardly from the front marginal edge of bottom wall 22. Central front wall section 14*b* is inclined upwardly and rearwardly from the upper marginal edge of lower wall section 14*a* to form an obtuse angle therewith and upper front wall section 14*c* inclines upwardly and rearwardly from central front wall section 14*b* until its upper marginal edge adjoins the front marginal edge of top wall 20. There is formed in central front wall section 14*b* a substantially rectangular opening 50 communicating directly with the interior of firebox housing 12 and providing access to combustion chamber 34. A raised metal flange 52 frames the opening 50 and at least one cast iron door 54, 56 (in the preferred form shown in the Figures two doors are illustrated) is hingedly mounted by hinge assemblies 58 on central front wall section 14*b* to allow the doors to open outwardly in a lateral fashion, in such a manenr that when swung to the closed position the cast iron doors sealingly close the opening by bearing against metal frame flange 52. At least the lower horizontal element 52*a* of frame flange 52 includes an undercut portion 53 for engaging door latching mechanism 60. The unique angle of central front wall section 14*b*, inclined upwardly and rearwardly from the vertical, insures that when the doors are swung closed, their weight causes them to seal against frame 52 and to automatically latch. For the same reasons the doors cannot be inadvertently opened by one brushing past them. To open the doors, insulated handles 62, preferably mounted along the lower marginal edge of the doors, are used to unlatch the doors and sufficient force applied to them to pull against the weight of the doors which, because of the angle of central front wall section 14***b*, tend to remain in the closed position. However once the doors are unlatched and opened, their weight together with the angle of central front wall section 14*b* maintains them in the open position and prevents them from inadvertently swinging closed during the loading of logs through opening 50.

As can be seen most clearly from FIGS. 3–6, doors 54, 56 are constructed of integrally cast iron frames members arranged in a unique and attractive design. A piece of heat tempered glass 64 is mounted on the inside (combustion chamber side) of each door 54, 56 and held in place by metal hold-down strips 66 secured, as by screws, to the cast iron frame at their ends and extending along substantially the entire top and bottom margins of the glass plates. It is frequently desirable to interpose a resilient layer (not shown) between the glass plate 64 and the hold-down strips 66 to prevent chipping or cracking of the plates. Depending from the bottom margin of each door, preferably adjacent the side margin remote from the hinge assembly 58, is latching mechanism 60. Mechanism 60 comprises an S-shaped clip 68 having a horizontally disposed central flange 70, a downwardly extending front flange 72 and an upwardly extending rear flange 74. The central flange 70 is supported from the lower margin of each stove door by two or more screws 76 tapped into the door margin. A compressed spring 78 surrounds each screw with one end of each spring bearing against the screw head and the other end bearing against the underside of the central flange 70. The spring 78 normally orients the S-shaped clip 68 in such a manner that the central flange 70 is horizontal. When the door 54, 56 is closed against frame flange 52, with the central flange 70 in the horizontal position, the upwardly extending rear flange 74 engages the undercut portion 53 of the frame flange 52 to latch the door 54, 56 in the closed position. The downwardly extending front flange 72 is embedded in a recess formed in insulated, e.g., wooden, handle 62 and the handle attached to flange 72 by any conventional fastening means, e.g., cement or set screws which pass through the bottom of the handle and engage a threaded notch in the flange 72. The screws 76 provide a fulcrum about which the "S" clip 68 may pivot in a forward direction to compress the springs 78 and disengage rear flange 74 from the undercut 53. However the handle 62 abuts screws 76 and the "S" clip 68 cannot pivot rearwardly from its normal horizontal position.

Figure 5:
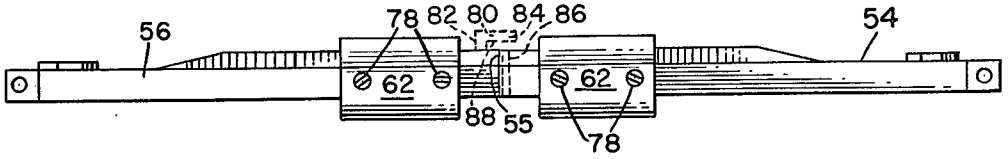
FIG. 5 is a bottom plan view of the doors illustrated in FIG. 6.
Figure 4:
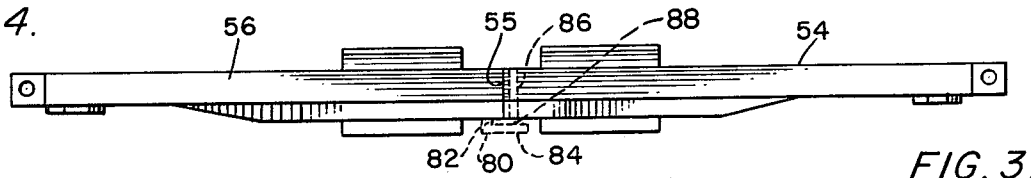
FIG. 4 is a top plan view of the doors illustrated in FIG. 6 showing, in phantom, an optional safety feature for the prevention of flash out.
Figure 3:
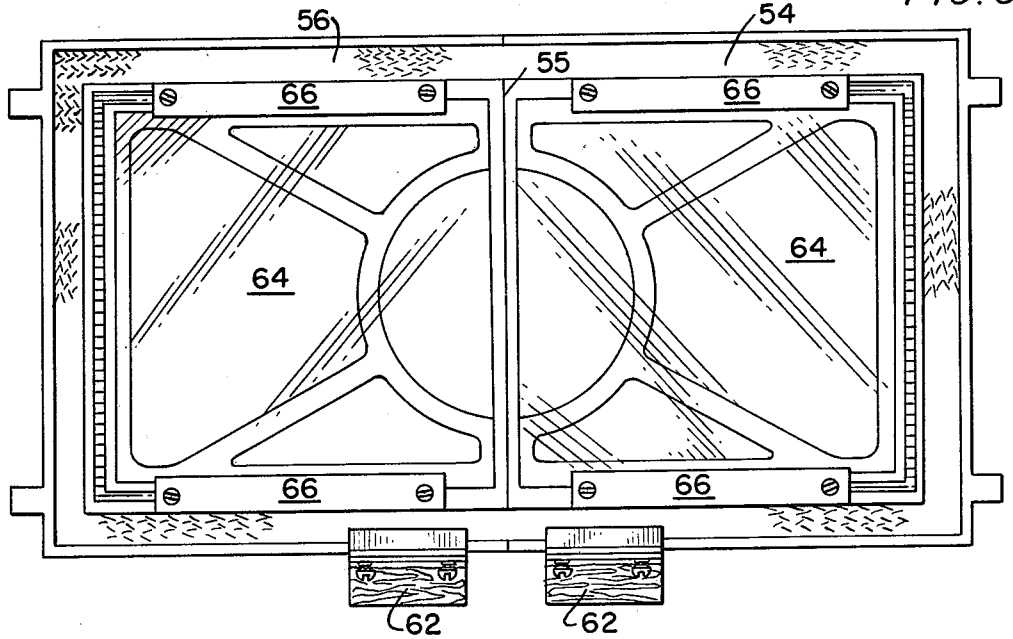
FIG. 3 is a rear elevational view of the stove doors showing the means for mounting the tempered glass windows therein.
Figure 6:
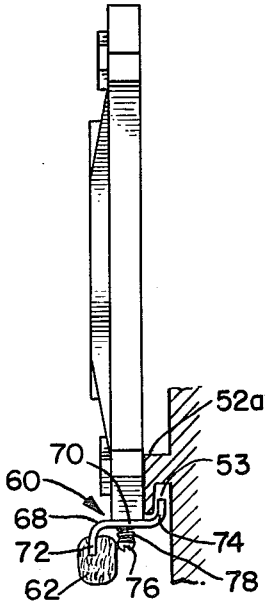
FIG. 6 is a side elevational view of the doors illustrated in FIG. 3 showing the means by which the door latching mechanism engages the stove body.

In a preferred, but optional, embodiment of the invention, where two stove doors close opening 50 as shown in FIGS. 3–5, an "L" shaped flange member 80 is mounted on one of the doors. Member 80 includes a first leg 82 projecting forwardly from the front wall of door 56 and a second leg 84 extending laterally across the closure joint 55 of the doors. Formed in door 54 immediately adjacent the margin thereof closest to door 56, i.e., adjacent joint 55, is at least one aperture 86 which communicates the combustion chamber 34 with the outside of the stove. This aperture 86 is concealed by second leg 84 of the "L" shaped flange member 80 to prevent direct or straight through access from the inside to the outside of stove 10. However, because first leg 82 projects forwardly from door 56, air is allowed to pass into the space 88 between the "L" shaped flange 80 and the doors 54, 56 and, therefore from the outside of stove 10 through aperture 86 into the combustion chamber 34. This at least one aperture 86 is desirably located above the level of the burning wood and serves to promote complete combustion and to prevent "flash out" under normal firing of the stove. The latter is an undesirable condition in which the gases burning within chamber 34 and the flame associted with them are drawn out of the stove when a door is opened and a sudden abundance of air is made available for combustion. Instead of a single aperture, at least one aperture 86 may comprise a plurality of apertures. "Flash out" can also be prevented by providing apertures (not shown) elsewhere in the firebox housing in communication with the combustion chamber 34.

An air chamber 48 extends laterally along the front, lower portion of the firebox housing 12. Chamber 48 is defined by lower front wall section 14*a* as its front wall, front firebrick wall 46 as its rear wall, adjacent portions of side walls 16, 18 as its side walls, the adjacent portion of bottom wall 22 as its bottom wall, and a substantially horizontal shelf 90 extending between firebrick wall 46 and front wall 14 as the top wall. In a preferred form, shelf 90 extends from firebrick wall 46 forwardly to the intersection between lower and central front wall sections 14*a* and 14*b*. As can be seen most clearly in FIG. 2, air chamber 48 is substantially trapezoidal in cross section. A damper 92 is formed in bottom wall 22 within air chamber 48 through which the flow of air into the firebox housing 12 is controlled. As will be appreciated, dependent upon the state of the fire and the rate of combustion desired, damper 92 may be completely closed, completely opened or set as some intermediate position. The damper 92 may be mechanically controlled, as by a chain (not shown) connected between the damper and an operating handle (not shown) mounted on the stove 10. More desirably, the damper is controlled by temperature sensitive thermostatic means, such as bimetallic temperature controls readily available from commercial sources. The damper 92 is located in bottom wall 22 to draw in cool air from floor level and to promote better circulation of heated air throughout the room. It is preferred that the damper area not exceed about 6 square inches so that chimney temperatures do not exceed 1000° F. even should the damper system malfunction and stick in the completely open position. Air admitted to air chamber 48 through damper 92 may be passed through one or more openings 94 in firebrick wall 46 directly to the wood burning in combustion chamber 34. Preferably these openings 94 are at about the level of the logs and are disposed along the entire width of stove 10. The air in chamber 48 may also pass through a series of louvres or openings 96 disposed along the length of shelf 90 (width of stove 10) adjacent front wall 14. Air passing through openings 96 sweeps across the glass plates 64 of doors 54, 56 to clean and cool the glass. By forming the openings or louvres 96 in shelf 90 closely adjacent front wall 14 and because of the unique angle of central front wall section 14*b*, a film of cooling air is continuously passed across the glass plates 64 in the stove doors 54, 56.

INDUSTRIAL APPLICABILITY

In the most efficient use of the wood burning stove of the present invention, logs to be burned are placed into combustion chamber 34 by opening doors 54, 56 and inserting the logs through opening 50 in central front wall section 14b. The doors are closed and seal against metal frame 52 surrounding opening 50 to provide for air tight combustion. The doors 54, 56 are latched in the closed position by the engagement of upwardly extending rear flange 74 of clip 68 with the undercut portion 53 of frame flange 52.

Draft air enters the firebox housing 12 via damper 92 in air chamber 48 and openings 94 in firebrick wall 46 and openings 96 in shelf 90. It should be appreciated that the air tight combustion of wood is in reality the burning of gases and not the burning of the solid mass of the wood. Thus the amount of heat generated is dependent upon the rate of combustion within combustion chamber 34 which, in turn, depends upon the rate of air flow through damper 92. This latter rate is controlled by thermostatic temperature sensing means. Cool air from floor level (shown by solid line arrows) passes through damper 92 into air chamber 48 in which the air is preheated by the combustion heat from within combustion chamber 34. Thus it is preheated air which is fed to the combustion chamber 34 through openings 94 to enhance the efficiency of wood burning therein and preheated air which passes over the glass plates 64 in doors 54, 56. As combustion proceeds within chamber 34 the hot products of combustion and the preheated air (shown by solid line arrows) passing through openings 94 and 96, which is further heated by the combustion, move upwardly through firebox housing 12. In so doing they are caused to flow across a plurality of heat exchanger tubes 98 and to transfer at least a portion of their thermal energy content to air flowing by convection (shown by broken line arrows) within and through tubes 98. After passing over tubes 98, the somewhat cooled hot combustion gases and heated air leave firebox housing 12 via opening 30 in top wall 20 (shown by solid line arrows) and through flue 28 and chimney 32 to the outside of the house.

Heat exchanger tubes 98 are inclined forwardly and upwardly from rear wall 24 through firebox housing 12 and protrude through upper front wall section 14c. Air flow (shown by broken line arrows) through tubes 98 is by normal convection from the tube air inlets at rear wall 24 toward the tube outlets at upper front wall section 14c where heated air is discharged into the room. Preferably 3 to 5 heat exchanger tubes are employed and are so positioned within firebox assembly 12 that they are directly licked by the combustion flames. Such positioning causes minimum ash build up on the tubular heat exchange surfaces, increases heat output and minimizes maintenance. If desired, the BTU rating of the stove 12 can be increased by affixing an optional blower unit (not shown) to the rear wall 24 to force additional air flow through heat exchanger tubes 98. Such a blower unit is conventional in nature and comprises an electric motor operated fan which draws additional cool room air from the rear of the stove and passes it through the heat exchanger tubes, giving off additional heat at the front of the stove. In addition, whether or not a blower unit is employed, the combustion within the stove causes the top wall 20 to become hot and can serve as a hot plate for warming liquids and the like.

I claim:

1. A wood burning stove for heating a designated space comprising:

(a) a housing having top, bottom, front, rear and side walls, an access opening in said front wall for inserting therethrough wood to be burned and at least one door closing said opening for making said housing air tight;

(b) a combustion chamber within said housing for burning said wood, whereby combustion gases are produced in said combustion chamber and rise;

(c) an air chamber within said housing in air flow communication with said combustion chamber whereby air flowing from said air chamber is heated in said combustion chamber and rises, said air chamber defined by the intersection of said front wall, said bottom wall, a first interior wall extending generally upwardly from said bottom wall and a second interior wall extending generally rearwardly from said front wall below said at least one door;

(d) damper means formed in said bottom wall in said air chamber for controlling air flow into said air chamber;

(e) means associated with said air chamber for directing at least a portion of said air flow from said chamber across the surface of said door within said housing;

(f) flue means adjacent the top of said housing for discharging combustion gases and heated air therefrom; and (g) conduit means having air inlet openings in at least one wall of said housing and air outlet openings in another wall of said housing, said outlet openings communicating with said space to be heated, said conduit means disposed within said housing in the path of said rising combustion gases and heated air, whereby said combustion gases and heated air give up at least a portion of their thermal energy to said air in said conduit means before being discharged through said flue means and said heated air in said conduit means is discharged through said outlet openings into said space to be heated.

2. A stove, as claimed in claim 1, wherein said conduit means comprises a plurality of tubular heat exchange conduits, said inlet openings are in said rear wall, said outlet openings are in said front wall and said conduit means incline forwardly and upwardly from said rear wall to said front wall.

3. A stove, as claimed in claim 1, wherein said flow means comprises a flue pipe extending upwardly from and communicating with said housing through an opening in said top wall.

4. A stove, as claimed in claim 1, wherein said air flow communication between said combustion chamber and said air chamber comprises at least one opening in said first interior wall.

5. A stove, as claimed in claim 1, wherein said front wall includes at least upper and lower sections, said lower section comprising a wall of said air chamber and extending generally downwardly from said second interior wall, said upper section including said access opening therein and extending generally upwardly and rearwardly from said second interior wall whereby said first and second sections form an obtuse angle therebetween.

6. A stove, as claimed in claim 5, wherein said air outlet openings are formed in said front wall and disposed above said access opening therein.

7. A stove, as claimed in claim 1, including a forwardly projecting flange surrounding at least a portion of said access opening, said at least one door hingedly mounted on said front wall and sealingly bearing against said flange when said at least one door is closed.

8. A stove, as claimed in claim 7, including latch means mounted along a margin of said at lest one door and an undercut in said flange portion at a location corresponding to the location of said latch means, said latch means engaging said undercut to positively latch the door against said flange when said at least one door is closed.

9. A stove, as claimed in claim 1, further including at least one aperture formed in said housing above the level of said wood in said combustion chamber for maintaining the outside of said stove in air flow communication with said combustion chamber and flange means supported by and spaced from said housing having a portion overlying said aperture, whereby straight through air access from the outside to the inside of said stove via said aperture is prevented by said overlying flange portion but air access from the outside to the inside of said stove via the space between said overlying flange portion and said apertured housing and then via said aperture is permitted.

10. A stove, as claimed in claim 9, wherein said at least one aperture is formed in at least one door of said housing.

11. A stove, as claimed in claim 1, wherein said means associated with said chamber comprises at least one opening in said second interior wall adjacent said front wall for directing said air flow from said air chamber through said opening and across the surface of said door.

12. A stove, as claimed in claims 11 or 5, wherein said at least one door includes a glass panel therein for viewing the wood burning within said housing.

* * * * *